US006801205B2

(12) United States Patent
Gardiner et al.

(10) Patent No.: US 6,801,205 B2
(45) Date of Patent: Oct. 5, 2004

(54) METHOD FOR REDUCING TRANSPORT DELAY IN A SYNCHRONOUS IMAGE GENERATOR

(75) Inventors: Harold Dee Gardiner, Sandy, UT (US); Steve O. Hadfield, Kaysville, UT (US)

(73) Assignee: Evans & Sutherland Computer Corporation, Salt Lake City, UT (US)

( * ) Notice: Subject to any disclaimer, the term of this patent is extended or adjusted under 35 U.S.C. 154(b) by 230 days.

(21) Appl. No.: 09/731,683

(22) Filed: Dec. 6, 2000

(65) Prior Publication Data

US 2002/0109697 A1 Aug. 15, 2002

(51) Int. Cl.[7] ..... G09G 5/399
(52) U.S. Cl. ..... 345/539; 345/544
(58) Field of Search ..... 345/422, 441, 345/539, 55, 532, 545, 672, 572, 84, 522, 505, 531, 502, 427, 553, 419, 8, 421, 503, 547, 544, 473; 348/443; 365/230.01; 706/27; 702/150

(56) References Cited

U.S. PATENT DOCUMENTS 5,444,839 A * 8/1995 Silverbrook et al. ..... 345/441
6,100,906 A * 8/2000 Asaro et al. ..... 345/539
6,407,736 B1 * 6/2002 Regan ..... 345/422

OTHER PUBLICATIONS

Bishop, Fuchs, McMillan and Zagier, "Frameless Rendering: Double Buffering Considered Harmful," Computer Graphics Proceedings, Annual Conference Series, 1994.

Regan and Pose, "Priority Rendering with a Virtual Reality Address Recalculation Pipeline," Computer Graphics Proceedings, Annual Conference Series, 1994.

Torborg and Kajiya, "Talisman: Commodity Realtime 3D Graphics for the PC," Computer Graphics Proceedings, Annual Conference Series, 1996.

* cited by examiner

*Primary Examiner*—Matthew C. Bella
*Assistant Examiner*—Dalip K. Singh
(74) *Attorney, Agent, or Firm*—Thorpe North & Western LLP

(57) ABSTRACT

A method for enabling reduced transport display in a computer image generator connected to a host simulator which receives real-time input. The first step is performing real-time matrices calculations with the real-time input. The next step is processing geometry for primitives in a scene and storing the primitives in a double-buffered geometry buffer. The geometry buffer toggles as soon as the geometry processing is done without waiting for a field sync signal which reduces the transport delay normally found in image generation systems. Another step is rendering the primitives into a pixel frame buffer as soon as the geometry buffer toggles. The final step is displaying the pixel frame buffer. The rendering hardware and geometry processing hardware can also include enough processing power to complete the geometric transformations and rendering and in less than one display frame. Allowing the geometry and rendering to complete faster allows reduces the transport delay because the geometry buffer can toggle sooner and the pixels can be displayed sooner.

20 Claims, 7 Drawing Sheets

METHOD FOR REDUCING TRANSPORT DELAY IN A SYNCHRONOUS IMAGE GENERATOR

TECHNICAL FIELD

The present invention relates generally to computer graphics and virtual image generation. More particularly, the present invention relates to a method for reducing transport delay in a synchronous graphics image generator for real-time simulators.

BACKGROUND ART

For many years image generators have been a key component of simulation devices used to train operators such as airline pilots. The value of the training experience is highly dependent on the realism of the simulation. One aspect of simulation devices that has received much attention over the years is transport delay, or latency. Transport delay is defined as the time for a stimulus, such as the pilot moving the control stick, until the last pixel on the screen has been drawn 24, as shown in FIG. 1.

Many training simulators have a house sync 20 that is used to synchronize all of the simulation hardware. Each time the vehicle host computer receives a house sync pulse, it will sample the current position of the controls and switches and compute the behavior of the vehicle. Upon completion, the updated positional information will be sent to the image generators so the display image can be updated. The time it takes to actually sample the controls and switches and then send this information to the image generator is the host delay 22. The image generator also has a field sync 26 which times and regulates the image generator functions.

One important area of delay is the delay of the image generator. The image generator's portion of this delay is defined as the time from when the image generator receives a position update from the host computer until the last pixel is drawn on a visual display which represents the new position 28. Note that the field sync pulses have the same period as the house sync, but they are not necessarily aligned.

Two aspects of transport delay are critical to training. The first aspect is determinism, or repeatable delay. The second important aspect is the length of the transport delay. If the transport delay does not remain constant, or if the delay is too long, the operator will often be overcome with simulator sickness.

There are two basic architectures in use today for simulation visual systems. One architecture provides a shorter transport delay than the other, but it is substantially more expensive and less deterministic than the other approach. Typical workstation visual systems consist of the major processes, as shown in FIG. 2A. A simulator host computer sends an eye position update to the image generator. The visual system has a real-time controller which receives this update and computes the transformation matrices and other parameters necessary to render an image from the new current position 10. Those transformation matrices are then applied to all of the potentially visible primitives (polygons, lines, dots, etc.) in the simulation database 12. Once transformed into screen space, the primitives are loaded into the FIFO queue 13. Then the primitives can be rendered 14 into a pixel frame buffer memory 15, and displayed on the pilot's view screen 16.

This first basic architecture is a standard three-dimensional (3D) graphics computer or a workstation system which can be used to perform these operations. With such an architecture, the visual system's transport delay is illustrated in FIG. 3. The vertical arrows 30*a*, 30*b*, 30*c* represent the transfer of positional information from the host computer to the image generator. The dark shaded boxes represent the flow of one field of data through the graphics pipeline. The box indicates the amount of time allocated for each process, while the shaded portion indicates when the process is active. Usually the process will complete before the allocated time is up, as indicated by the sloped right edge of the shaded portion. If the process takes longer than the available time, the system will be in an overload condition. The lighter shaded boxes show how adjacent fields are processed back to back.

The simulation host computer sends positional update information 30*a*–30*c* to the image generator once each display field. The real-time controller then computes the matrices and other At information needed to display the scene 32. The real-time calculations begin as soon as the system receives input from the host (the black down arrow 30*a*). The real-time controller computes the eye position matrices, computes the position and orientation of moving models, updates embedded system behaviors, and then begins processing the database. This computation usually takes about ½ of a field time. The amount of time needed for this computation is dependent on the database, the current eye position, and the number of complex auxiliary functions and behaviors.

The geometry processing then begins on the primitives in the scene 34. As each primitive is transformed, it is handed to the rendering hardware 36. Specifically, the geometry processing begins storing processed polygons in its output FIFO queue as quickly as possible. Once the FIFOs contain data, the rendering engine can begin processing those primitives. As pixels are produced by the rendering engine, they are stored in a double buffered pixel memory while the previous field's data is being sent to the display for screen refresh. One full field time is allocated for this process, but it is important to complete both processes before the end of the field time or the system will be in an overload condition. Once the new image has been completed and written into one side of a double buffered pixel frame buffer, the buffer will be ready to toggle, or swap, at the next field sync pulse. After toggling, the new image is presented to the display device 38. Thus, the total transport delay for the visual system is 2.5 fields. As mentioned, standard image generator transport delay is measured from the input of host data (the down arrow 30*a*) to the display of the very last pixel on the screen (the right edge of the darkened display box 38).

Unfortunately, this approach has drawbacks that make it difficult to maintain deterministic behavior. Primitives cannot be rendered until after the geometric transformation operations are performed. The time required to find primitives and transform them is highly dependent on the database structure and the current position within the database. The time required to render primitives is directly related to their size on the screen. It seldom occurs that the geometry and rendering processes require the same amount of time, so one process usually ends up waiting for the other. This means that either the geometry engine or the rendering engine will sit idle during some portion of the field which reduces the efficiency of the system. Specifically, the FIFO between the geometry process and the rendering process cannot always guarantee optimum performance. If the rendering engine receives many small polygons, the FIFO may be drained faster than the geometry process can generate new polygons. This can cause the rendering process to be starved, and waste valuable rendering time. On the other hand, the rendering process may run too slowly on very large polygons, causing the FIFOs to fill up and the geometry process to stall. Furthermore, this loss of efficiency will often cause the system to overload since the entire job cannot be completed on time. The interactions between the geometry process and rendering process make load management more difficult since it is difficult to isolate which process is causing the overload condition. As a result, many systems need more geometry and rendering hardware than was originally expected, which increases the cost of the overall system. This non-deterministic characteristic makes this architecture less than an optimum choice for simulation applications. The efficiency of this system can be improved by using very large FIFOs and delaying the rendering operation until the FIFOs are sufficiently filled by the geometry operations to prevent the rendering process from running dry. This improves the efficiency, but unfortunately increases the transport delay.

Referring now to FIG. 2B, a second basic architecture has been used for many years in systems that are designed specifically for simulation. Another doubled buffered memory 18 (in addition to the double buffered pixel frame buffer 15) is inserted between the geometry and rendering processes to completely isolate them from each other. This memory stores primitives and is referred to as the geometry buffer. This gives one full field time for geometry calculations 40 and the next field time for pixel rendering 42 as illustrated in FIG. 4. Then the rendered image is displayed in the final field time 44 and is in sync with the field sync 43. Of course, the processes are pipelined so each process is operating on something every frame and a new image is created each and every frame. The downside of this approach is obviously the increased transport delay caused by this additional buffer. As illustrated in FIG. 4, the transport time with this system is 3.5 fields.

This prior art process can also be illustrated in a flow diagram format, as shown in FIG. 5. The simulation host computer sends positional update information to the image generator 60 once each house sync (which is the same time interval as the display field time). The real-time controller then computes the matrices 62 and other information needed to display the scene. This computation usually takes about ½ of a field time 64. The geometry processing then begins 66 on the primitives in the scene. After all primitives have been transformed 68, the previous field has been rendered 70, and the field timer is done 72, the geometry buffer is toggled 74 and primitives are passed to the rendering hardware 76. One fall field time is allocated for each of these processes. Once the new image has been rendered and written into one side of a double buffered pixel frame buffer 78, the buffer will be ready to toggle, or swap, at the next field sync pulse 80. After toggling 82, the new image is presented to the display device 84.

The flow diagram of FIG. 5 follows one host input or house sync through the graphics pipeline. It should be noted that all processes actually occur every field time since a new input is received for each field time. Under normal operating conditions, the geometry process, the rendering process, and the display process (and thus the field sync pulse) all start at the same time. Furthermore, the geometry buffer and the pixel frame buffer toggle just prior to starting these processes.

SUMMARY

It has been recognized that it would be advantageous to develop a simulation system that reduces the transport delay in a cost effective image generator architecture.

The invention provides a method for enabling reduced transport display in a computer image generator connected to a host simulator which receives real-time input. The first step is performing real-time matrices calculations with the real-time input. The next step is processing geometry for primitives in a scene and storing the primitives in a double-buffered geometry buffer. The geometry buffer toggles immediately upon completion of the geometry processing. Another step is rendering the primitives into a pixel frame buffer after the geometry buffer toggles. The final step is displaying the pixel frame buffer.

In accordance with another aspect of the present invention, the system is a method for enabling reduced transport delay in a computer image generator. The method includes the step of receiving real-time input from a simulation host computer to perform real-time matrices calculations. The following step is processing geometry for primitives in a scene and storing the primitives in a double-buffered geometry buffer. The geometry buffer toggles immediately upon completion of the geometry processing without waiting for a field sync signal, which reduces the transport delay normally found in image generation systems. The next step is rendering the primitives into a pixel frame buffer by using enough rendering hardware to complete the rendering in less than one display frame, wherein the rendering begins as soon as the geometry buffer toggles. Finally, the pixel frame buffer is displayed.

Additional features and advantages of the invention will be set forth in the detailed description which follows, taken in conjunction with the accompanying drawings, which together illustrate by way of example, the features of the invention.

DETAILED DESCRIPTION

Figure 1:
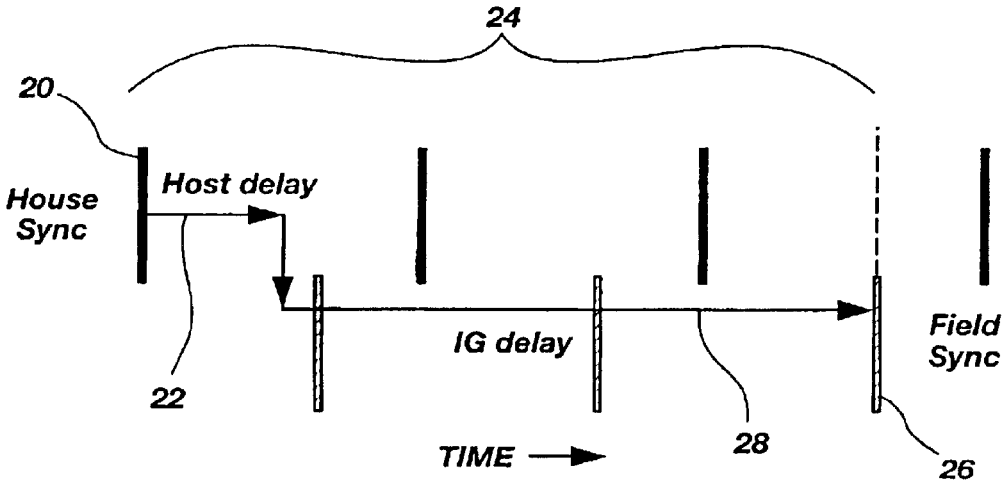
Fig. 1 (PRIOR ART)
FIG. 1 is a time line diagram of house sync signals with respect to field sync signals and the length of system transport delay.
Figure 2A:
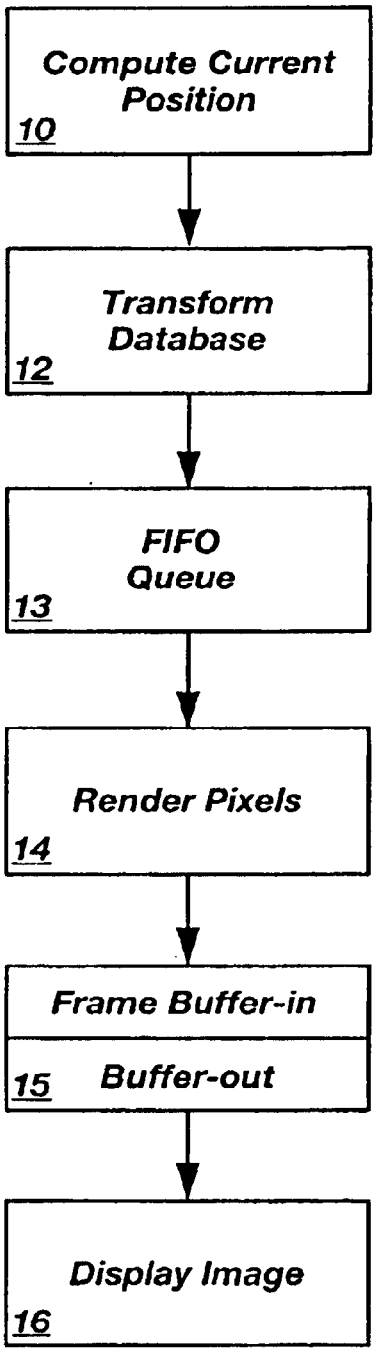
Fig. 2A (PRIOR ART)
FIG. 2A is a flow chart illustrating the major processes in a workstation graphics system.
Figure 2B:
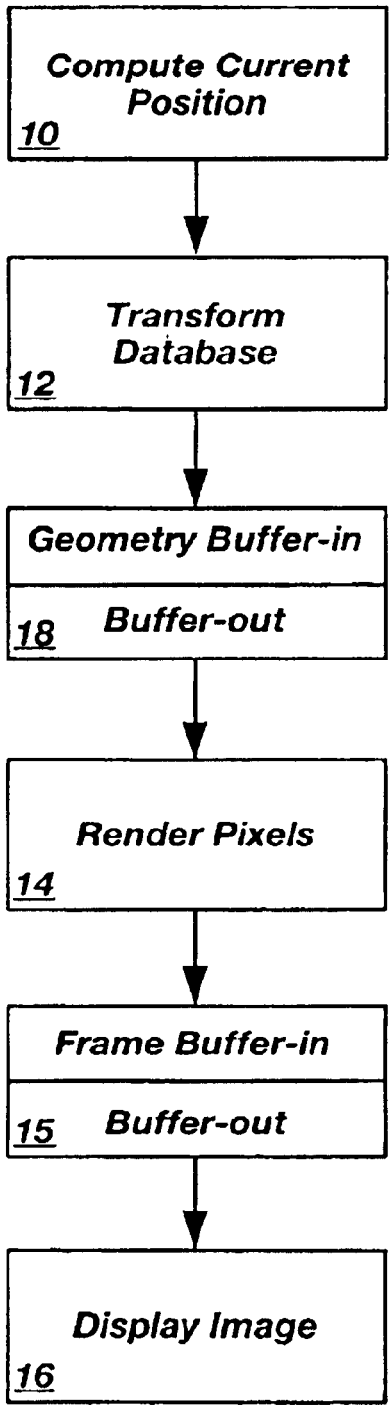
Fig. 2B (PRIOR ART)
FIG. 2B is a flow chart illustrating the major processes in an image generator.
Figure 3:
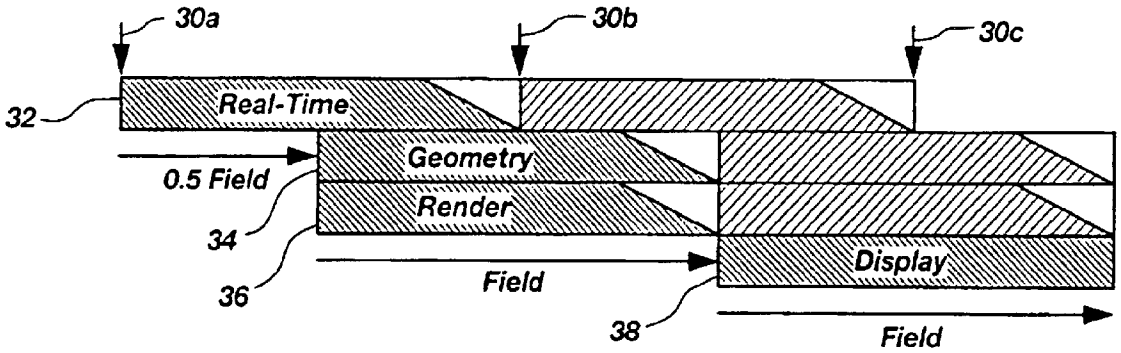
Fig. 3 (PRIOR ART)
FIG. 3 illustrates a time line of the transport delay in a workstation graphics architecture.
Figure 4:
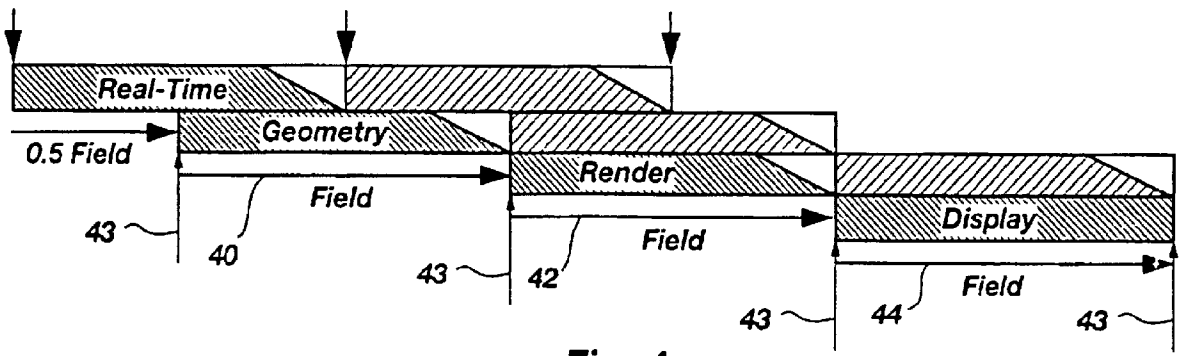
Fig. 4 (PRIOR ART)
FIG. 4 illustrates a time line of the transport delay in an image generator architecture.

For the purposes of promoting an understanding of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present device provides a means to improve the transport delay in an image generation system that uses a geometry buffer between the geometry and rendering processes. The invention maintains the performance efficiency advantages of an image generation system while reducing the total transport delay and staying synchronized with the display device.

Over the years, most simulation systems have run at a 60 Hz field rate. The total transport delay can be shortened if the system operates at faster field rates such as 85 Hz. Even though most computers refresh the display at these higher rates, the current field dependent architecture and total system cost for a simulation graphics device has made using this faster field rate prohibitive.

One key aspect of an image generation system is the display device. Most simulation systems include some form of a mock cockpit in order to maximize the realism of the training experience. These mock cockpits often include very expensive and sophisticated display configurations. Many systems even use complex projectors that display images on the inside of a large dome. These projectors have extremely critical specifications in terms of image sharpness, brightness, and contrast. It is seldom possible to use generic PC (personal computer) monitors for such applications. In order to achieve the high brightness and contrast objectives, many high end projectors are designed specifically to run at 60 Hz.

Figure 6:
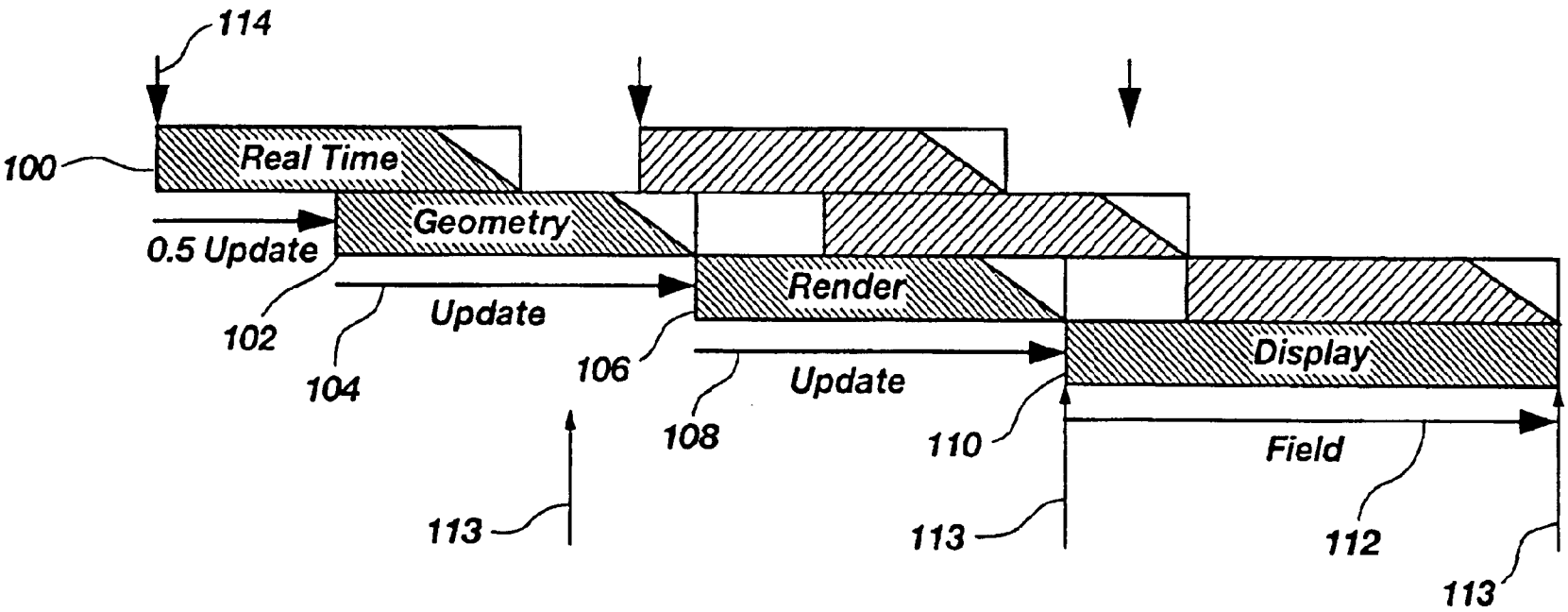
FIG. 6 illustrates a time line diagram of the reduced transport delay provided in the present invention.

This present invention provides a means to use a 60 Hz or another rate specific display device while running the image generator at a faster rate to reduce transport delay. This concept is illustrated in FIG. 6. Conventionally, image generator system designers have believed that it was necessary to maintain deterministic behavior by constraining each portion of the image generation process to a display field or frame. Of course, it is important that the image generator stay synchronized to the host input signal, which is occurring at the house sync rate (also the display rate). However, it is not necessary to run various processes within the image generator at that same rate.

FIG. 6 illustrates that the real-time information is received and processed first 100. The time allocated for the real-time calculation is less than the time until the next host update or less than a display field time. One half of an update period later the geometry process 102 begins and stores processed primitives in a double-buffered geometry buffer. It is important to note that the geometry process update period 104 is also less than a display field time 112. Immediately upon completion of the geometry processing of the primitives, the geometry buffer toggles and the primitives are passed to the rendering hardware 106 or rendering process. Further, the rendering process update period 108 takes less than one display field time. Reducing the time needed for processing during the geometry and rendering steps means that the displayed information 110 is nearer to the host display sync 114. Thus, the overall transport delay between receiving the real-time positional information and the actual display of an image has been reduced. This reduced transport delay also provides the advantage that the physical real-time controls used by the simulator operator are more responsive and the simulator operator is less likely to become motion-sick.

The reason that the geometry and rendering step can have reduced processing times is that enough hardware is included for those processes to allow them to complete in less time than a display frame. This is possible in part because graphics hardware has become somewhat cheaper. Thus, enough rendering horsepower can be provided to process the image faster than the display field rate. This faster rate, termed update rate, directly reduces the transport delay.

Just increasing the speed of these processes is not enough to reduce the transport delay. The image generation system must also be able to toggle the geometry buffer as soon as the geometry processing is done and the previous field's rendering is done. The present device allows the geometry buffer to toggle immediately upon completion of the geometry processing. Otherwise, the geometry processing completes and waits for a field sync before the geometry buffer toggles. If the geometry processor must wait to toggle when it is faster than a display frame, then any reduced update time is lost. This invention toggles the geometry buffer without waiting for the display period to expire.

So, instead of having a transport delay of 3.5 display fields, there is a transport delay of 2.5 update fields plus 1 display field. Since an update cycle time is shorter than the display field time, the transport delay is reduced. Notice that the geometry processing start and render start in FIG. 6 are no longer coincident with the display start or field sync 113.

Notice that each process still starts once per display field time, it just completes its job in less time than a display period. Since the process cannot be started again until the next host input is received, the process conventionally sits idle for some percentage of the time (as shown by the white spaces in the figure). Prior art systems use this available time to process more primitives or pixels. In this invention, the extra processing capacity is used to reduce transport delay.

In other words, sufficient graphics hardware is used to meet the training simulation specifications at a rate faster than the display rate. For example, the display can be running at 60 Hz while the image generator is configured to run at 85 Hz. Of course, the image generator is more expensive because it has to meet a higher performance level, but this configuration reduces the transport delay.

Figure 5:
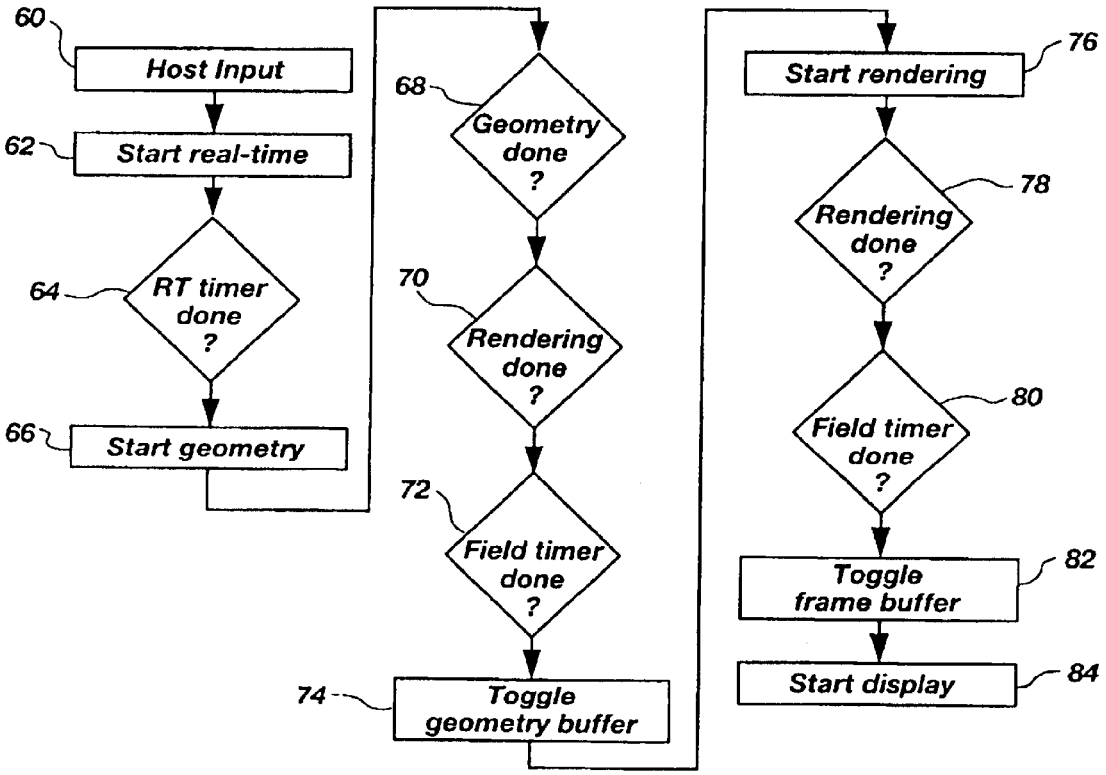
Fig. 5 (PRIOR ART)
FIG. 5 illustrates a detailed flow diagram of the processes used for image generation as in FIG.4.
Figure 7:
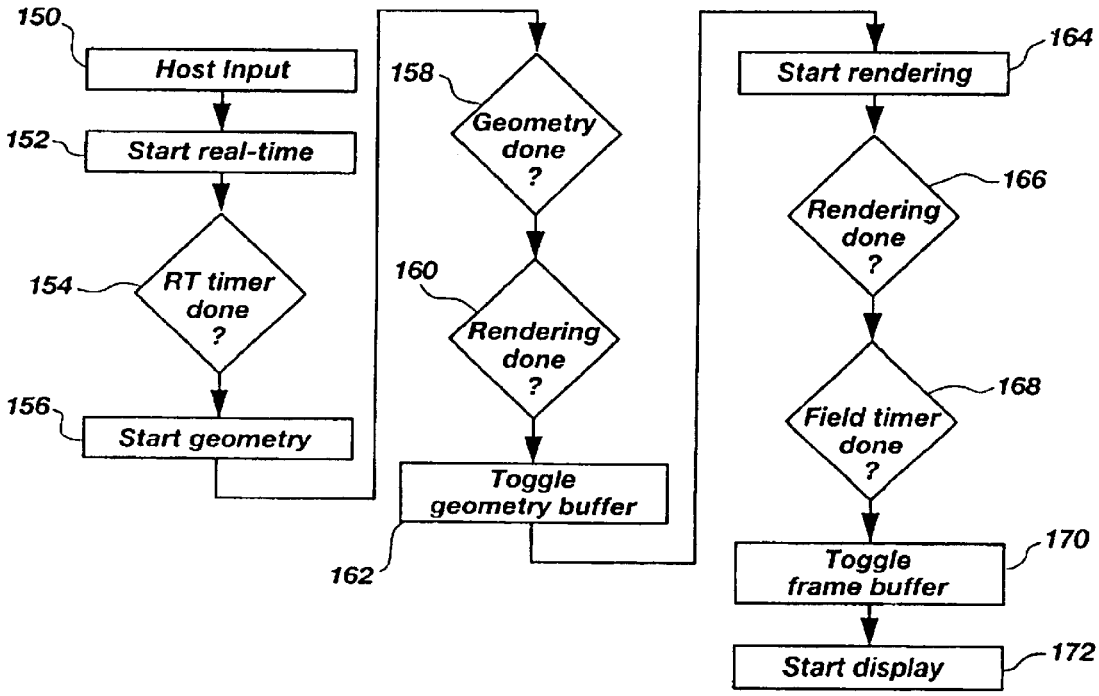
FIG. 7 illustrates a detailed flow diagram of the processes used for image generation as in FIG. 6.

FIG. 7 illustrates an embodiment of the present invention that can be compared to FIG. 5 with some notable changes. The flow chart shows that the geometry process 156 operates on the scene primitives, and then the system checks to see if the geometry processing is complete 158. If the geometry processing and the rendering of the last frame 160 are complete then the geometry buffer will toggle 162. It should be pointed out that the field timer test of FIG. 5 has been eliminated. This allows the geometry process to toggle without waiting for the display period to expire.

By adding additional graphics capabilities and allowing the geometry buffer to toggle independently, the present device can be configured for either a shorter transport delay or higher primitive and pixel performance levels. This allows users to select whichever is more important to the training task. The user now has a choice between scene complexity and transport delay. Rather than using all the graphics processing power for scene complexity, a portion can be used to reduce the image generator's transport delay. The image generator is configured to run at a rate faster than the display device, but it will still stay synchronized to the display device.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in implementation, form, function and manner of operation, and use may be made, without departing from the concepts of the invention as set forth in the claims.

What is claimed is:

1. A method for enabling reduced transport display in a computer image generator connected to a host simulator which receives real-time input, comprising the steps of:

(a) performing real-time matrices calculations with the real-time input;

(b) processing geometry for primitives in a scene and storing the primitives in a double-buffered geometry buffer, wherein the geometry buffer toggles immediately upon completion of the geometry processing and rendering of the last frame;

(c) rendering the primitives into a pixel frame buffer after the geometry buffer toggles; and (d) displaying the pixel frame buffer.

2. A method as in claim 1, wherein step (b) further comprises the step of toggling the geometry buffer without waiting for a field sync.

3. A method as in claim 1, wherein step (b) further comprises the step of toggling the geometry buffer without waiting for the display period to expire.

4. A method as in claim 1, wherein step (b) further comprises the step of toggling the geometry buffer without using a field timer.

5. A method as in claim 1, wherein step (b) further comprises the step of using enough geometry processing hardware to complete the geometry processing in less than one display frame.

6. A method as in claim 1, wherein step (b) further comprises the step of using enough rendering processing hardware to complete the rendering processing in less than one display frame.

7. A method as in claim 1, wherein step (b) further comprises the step of using enough real-time processing hardware to complete the real-time processing in less than one display frame.

8. A method as in claim 1, further comprising the step of using a double buffered pixel frame buffer.

9. A method for enabling reduced transport display in a computer image generator, comprising the steps of:

(a) receiving real-time input from a simulation host computer to perform real-time matrices calculations;

(b) processing geometry for primitives in a scene and storing the primitives in a double-buffered geometry buffer, wherein the geometry buffer toggles immediately upon completion of the geometry processing without waiting for a field sync signal;

(c) rendering the primitives into pixel frame buffer by using enough rendering hardware to complete the rendering in less than one display frame, wherein the rendering begins immediately after the geometry buffer toggles; and (d) displaying the pixel frame buffer.

10. A method as in claim 9, wherein step (b) further comprises the step of toggling the geometry buffer without waiting for the display period to expire.

11. A method as in claim 10, wherein step (b) further comprises the step of toggling the geometry buffer without using a field timer.

12. A method as in claim 9, wherein step (b) further comprises the step using enough geometry processing hardware to complete the geometry processing in less than one display frame.

13. A method as in claim 9, wherein step (b) further comprises the step using enough real-time processing hardware to complete the real-time processing in less than one display frame.

14. A method as in claim 9, wherein step (b) further comprises the step of using enough rendering processing hardware to complete the rendering processing in less than one display frame.

15. A method as in claim 9, further comprising the step of using a double buffered pixel frame buffer.

16. A method for enabling reduced transport display in a computer image generator, comprising the steps of:

(a) receiving real-time input from a simulation host computer to perform real-time matrices calculations;

(b) processing geometry for primitives in a scene and storing the primitives in a double-buffered geometry buffer, wherein the geometry buffer toggles immediately upon completion of geometry processing without waiting for a field timer to expire;

(c) rendering the primitives into a double buffered pixel frame buffer by using enough rendering hardware to complete the rendering in less than one display frame, wherein the rendering begins after the geometry buffer toggles;

(d) displaying a pixel frame buffer; and (e) reducing the time between receiving the real-time input and displaying the pixel frame buffer based on the reduced time required to complete the real-time, geometry, and rendering processing.

17. A method as in claim 16, wherein step (e) further comprises the step of reducing the transport delay by reducing the transport time between receiving a real-time signal from the host computer and a time when the display frame is displayed.

18. A method for enabling reduced transport display in a computer image generator connected to a host simulator which receives real-time input, comprising the steps of:

(a) performing real-time matrices calculations with the real-time input;

(b) processing geometry for primitives in a scene and storing the primitives in a double-buffered geometry buffer, wherein the geometry buffer toggles before a field sync is triggered;

(c) rendering the primitives into a pixel frame buffer after the geometry buffer toggles; and (d) displaying the pixel frame buffer.

19. A method as in claim 18, wherein step (b) further comprises the step of toggling the geometry buffer before the display period expires.

20. A method as in claim 18, wherein step (b) further comprises the step of toggling the geometry buffer without using a field timer.

* * * * *